United States Patent [19]

Tyndall

[11] Patent Number: 4,478,467

[45] Date of Patent: Oct. 23, 1984

[54] PORTABLE WORKSHOP

[76] Inventor: Howard W. Tyndall, 2923 E. Cavett St., Shreveport, La. 71104

[21] Appl. No.: 453,876

[22] Filed: Dec. 27, 1982

[51] Int. Cl.[3] ..... A47B 43/00

[52] U.S. Cl. ..... 312/250; 52/36; 52/79.5; 52/143; 211/87; 312/140.2; 312/258; 312/262; 312/319

[58] Field of Search ..... 52/36, 71, 79.5, 143; 108/60, 61; 211/57.1, 59.1, 87; 248/220.3; 312/140.1, 140.2, 210, 250, 258, 262, 237, 319; 182/151, 181

[56] References Cited

U.S. PATENT DOCUMENTS

| | | | |
|---|---|---|---|
| 1,889,760 | 12/1932 | Peters | 312/258 X |
| 2,939,755 | 6/1960 | Wyant | 312/223 X |
| 3,041,957 | 7/1962 | Liptay | 312/223 X |
| 3,224,489 | 12/1965 | Haberthier | 52/71 X |
| 3,588,209 | 6/1971 | Nathan | 312/140.2 |
| 4,182,432 | 1/1980 | Cossitt | 182/151 |
| 4,344,540 | 8/1982 | Marschak | 248/220.3 X |

FOREIGN PATENT DOCUMENTS

| | | | |
|---|---|---|---|
| 1015966 | 1/1966 | United Kingdom | 312/258 |

*Primary Examiner*—William E. Lyddane
*Assistant Examiner*—Joseph Falk
*Attorney, Agent, or Firm*—John M. Harrison

[57] ABSTRACT

A portable, compact and fully equipped workshop which includes enclosure or cubicle characterized by four hinged panels mounted on rollers and containing interior cabinets, shelves and lighting, and further including a hinged counter positioned inside the enclosure and raised when the panels are in folded configuration. The counter can be deployed in horizontal position to provide additional work space when the panels are opened to provide access to the cabinets and shelves. Various hand and power tools, as well as miscellaneous supplies and equipment can be stored in compartments provided in the cabinets and on the shelves, and the panels can be locked into the folded configuration to secure the tools, supplies and equipment inside the enclosure.

4 Claims, 8 Drawing Figures

PORTABLE WORKSHOP

BACKGROUND OF THE INVENTION

1. Field of the Invention

This invention relates to work areas and workshops, and more particularly, to a portable, compact folding workshop which includes an enclosure or cubicle defined by multiple, hinged panels which support cabinets, shelves, lighting and pegboards for storing tools, equipment and supplies. The panels forming the enclosure can be locked to secure the tools, equipment and supplies inside the enclosure when the workshop is in folded configuration and is not in use. In a preferred embodiment of the invention the enclosure is open at the top and bottom and consists of four panels mounted on rollers to more easily facilitate moving of the enclosure and opening of the panels on the connecting hinges to provide access to the cabinets and shelves, and to the tools, equipment and supplies, for functional use of the workshop. When in folded, stored configuration the portable workshop occupies a relatively small space and can be easily deployed in a garage or carport or even in the corner of a room inside the home, and when deployed for use the work area is no larger than a conventional work bench of similiar facility. The portable workshop of this invention is designed to provide maximum expediency in the use of hand and power tools in a workshop environment which occupies minimum space.

2. Description of the Prior Art

Efforts to conserve space by using portable furniture and other folding, compact items of a functional or decorative nature are well known in the prior art. U.S. Pat. No. 150,194, to H. J. Barrett, discloses a "Folding, Portable Bar" which includes a central portion having folding side members in order to facilitate storage of the bar in a minimum of space. A similiar "Portable Bar" is disclosed in U.S. Pat. No. 2,260,586 to R. I. Sheldon, which bar is characterized by a center support having hinged drop leaves supported by outwardly extending side members. U.S. Pat. No. 1,348,073, to M. P. Almy, discloses a portable screen which is likewise comprised of a central support member having shelves therein and folding wings or outer portions to facilitate use of the screen in functional position with the wings unfolded, and in storage configuration, with the wings in folded position against the center portion. U.S. Pat. No. 3,353,885, to H. C. Hanson, discloses an "Expansible Multi-Purpose Cabinet" which includes telescoping cabinet portions which can be slidably displaced to provide a work area, with accessory members which unfold and open to deploy a mirror and provide access to interior shelves within the major support members. A similiar "Display Case" is disclosed in U.S. Pat. No. 1,336,899, to W. H. Gallagher, which display case includes a central support member having interior shelves and outwardly folding side members or wings which can be unfolded and deployed on hinges for decorative purposes. French Pat. No. 1,444,175 discloses a folding cabinet having multiple interior storage compartments and two major folding portions which are hinged at one edge and open to provide access to the interior compartments. The major cabinet members close on the hinges to facilitate storage of the cabinet in a minimum of space. U.S. Pat. No. 2,870,459, to R. F. Zabielski, discloses an item of folding furniture which includes a major support member having a pair of folding side members hingedly attached at opposite edges, with one of the side members further including shelves and a hinged desk top and supporting doors which open beneath the desk top to support the desk top when in functional position. One or more cots can be deployed from storage in the major support member between the two folding side members when the folding side members are deployed on the hinges away from the major support member.

In recent years due to the high rate of inflation and increased costs, there has been a growing trend toward economy of space and the undertaking of home projects individually, rather than by use of skilled labor provided by contractors. This trend is particularly noteworthy with regard to the "do it yourself" home projects, which usually require a work space or area of sufficient size to handle the projects in question. Since the average home contains little extra space to accommodate such projects, they sometimes go unattended, or must be accomplished by skilled labor at a high cost.

Accordingly, it is an object of this invention to provide a new and improved, portable, compact workshop which is characterized by an enclosure or cubicle formed of multiple, hinged panels, which enclosure, when in folded, stored configuration, can be closed and locked or otherwise secured, and can be opened to provide access to cabinets, shelves, work space and tools contained within the enclosure.

Another object of this invention is to provide a new and improved portable workshop having an enclosure characterized by an open top and bottom and having multiple, hinged panels mounted on rollers to facilitate moving of the enclosure and opening and closing of the panels, which enclosure, in functional configuration, opens to provide access to shelves and cabinets mounted in cooperation with the supporting panels, and in closed configuration, can be locked to secure tools, supplies and materials within the enclosure.

Yet another object of the invention is to provide a new and improved workshop which is characterized by a cubicle-type enclosure defined by four hinged panels mounted on rollers and adapted for locking or securing into the cubicle configuration when not in use in order to conserve space, and which opens into a generally linear spatial arrangement to provide access to pegboards, cabinets, shelves, and a horizontal work space attached to the panels.

Yet another object of the invention is to provide a new and improved portable, compact workshop which can be stored in a minimum of space and used substantially anywhere, and which in a preferred embodiment is characterized by an enclosure shaped by four hinged, wheeled panels of substantially the same size which can be closed to secure tools and materials inside the enclosure when in stored configuration, and opened into a substantially linear arrangement on the hinges when in functional configuration, to provide access to shelves, cabinets, and a horizontal work space which is extended by a hinged counter adapted to be folded into a substantially horizontal position between cabinets attached to the panels.

SUMMARY OF THE INVENTION

These and other objects of the invention are provided in a new and improved, portable and compact workshop which is characterized by an enclosure or cubicle defined by four hinged panels, two of which panels are hinged together along adjacent edges and are each provided with a panel facing disposed along the opposite edges for hinged attachment to the other panels, which panels can be folded on the hinges into an open top and bottom cubicle in stored configuration, and opened into a substantially linear spatial arrangement to provide access to shelves, cabinets and pegboards attached to the panels and containing tools and supplies, when in functional configuration. In a preferred embodiment the panels are mounted on rollers and are provided with a folding counter spanning the cabinets to increase the available horizontal work area.

BRIEF DESCRIPTION OF THE DRAWING

The invention will be better understood by reference to the accompanying drawings wherein.

DESCRIPTION OF THE PREFERRED EMBODIMENTS

Figure 1:
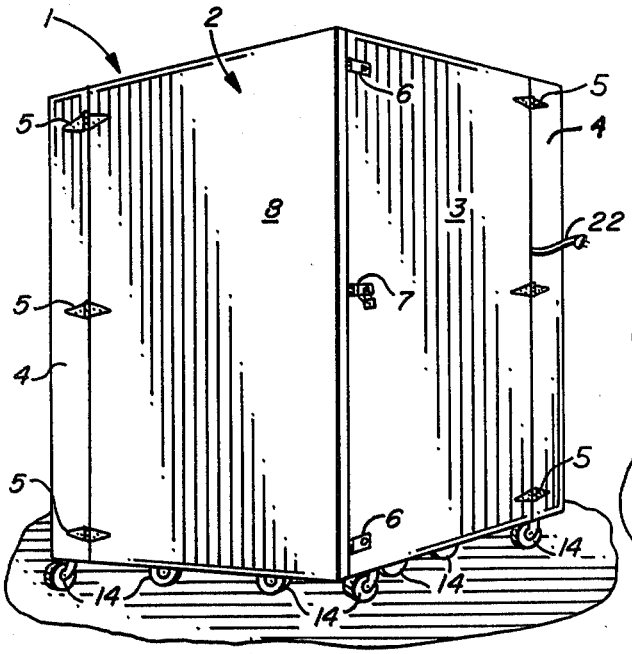
FIG. 1 is a perspective view of a preferred embodiment of the portable workshop in folded configuration.

Referring to FIG. 1 of the drawings, the portable workshop of this invention is generally illustrated by reference numeral 1, and is illustrated in folded, stored configuration where it occupies a minimum of space. Portable workshop 1 includes an enclosure or cubicle, generally illustrated by reference numeral 2, which is defined by a door panel 3 and a cooperating closure panel 8, which are both mounted on rollers 14, as illustrated. A set of three hasps 6, are each hingedly attached in spaced relationship to the unhinged edge of closure panel 8, and a lock 7 secures the center one of hasps 6 to a conventional eyelet secured to the door panel 3, in conventional fashion. In a preferred embodiment of the invention the door panel 3 is attached to a panel facing 4 by means of panel hinges 5, closure panel 8 is in turn attached to a second panel facing 4, by means of additional panel hinges 5, and each panel facing 4 is rigidly secured to one of rear panels 9, respectively, which are hinged together at adjacent edges, as hereinafter described.

Figure 3:
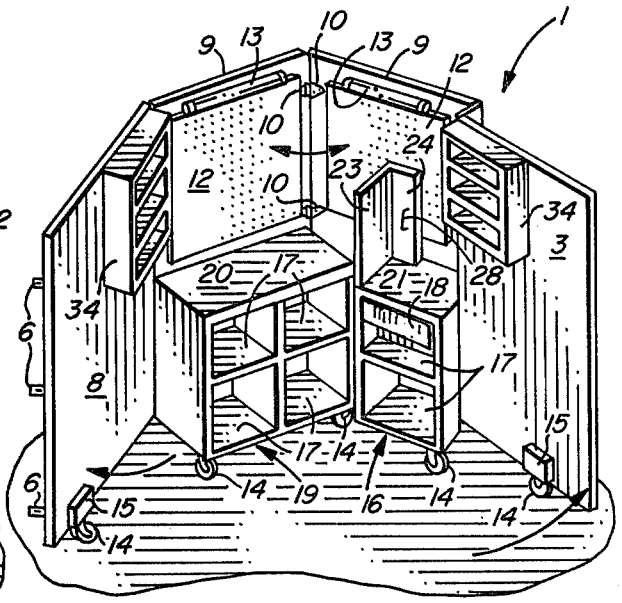
FIG. 3 is a perspective view of the portable workshop illustrated in FIGS. 1 and 2, with the panels further deployed on hinges to a partially open configuration.
Figure 2:
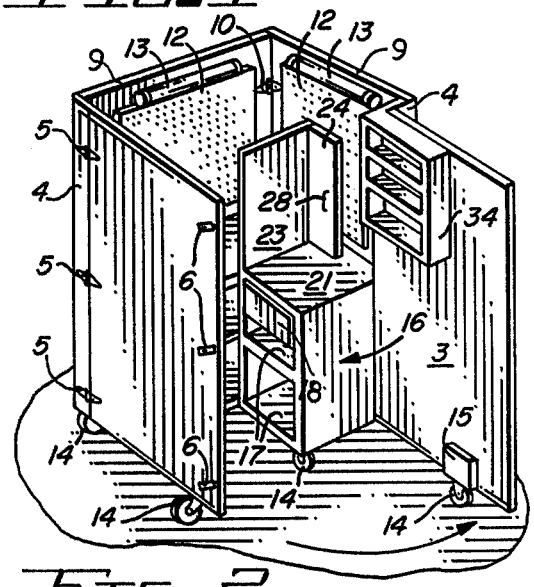
FIG. 2 is a perspective view of the portable workshop illustrated in FIG. 1, with one of the four hinged panels in open configuration.

Referring now to FIGS. 2 and 3 in sequence, the door panel 3 and closure panel 8 are partially opened on panel hinges 5, and rear panel hinges 10 are illustrated as attached to the inside surfaces of rear panels 9, to facilitate closing and opening of the rear panels 9. In a most preferred embodiment of the invention the rear panels 9 are each provided with a pegboard 12 on the inside surfaces and a single cabinet 16 is attached to one of the rear panels 9, while a double cabinet 19 is attached to the opposite one of rear panels 9, as illustrated in FIG. 3. Furthermore, shelves 34 are secured to the inside surfaces of door panel 3 and closure panel 8, respectively, and a pair of lights 13, are mounted on the rear panels 9 above the pegboards 12. Single cabinet 16 is provided with a horizontally-mounted single cabinet top 21, and the double cabinet 19 includes a double cabinet top 20 in substantially the same plane as single cabinet top 21, to provide divided horizontal work spaces when the portable workshop 1 is fully deployed, as hereinafter described. Both the single cabinet 16 and double cabinet 19 are provided with cabinet compartments 17 for storage of tools, supplies and equipment, as deemed expedient by the user. Furthermore, in a preferred embodiment the single cabinet 16 is also provided with a drawer 18 for additional storage capacity.

Referring now to FIGS. 1-4 of the drawings, in another most preferred embodiment of the invention the rollers 14 are secured to roller mounts 15, which are attached to the door panel 3, closure panel 8 and the rear panels 9, respectively, and rollers 14 are also provided on the bottom of single cabinet 16 and double cabinet 19, to more easily facilitate moving the portable workshop, both from one location to another and from the closed to the open configuration, and back to the closed mode, as illustrated in the opening sequence in FIGS. 1-4.

Figure 4:
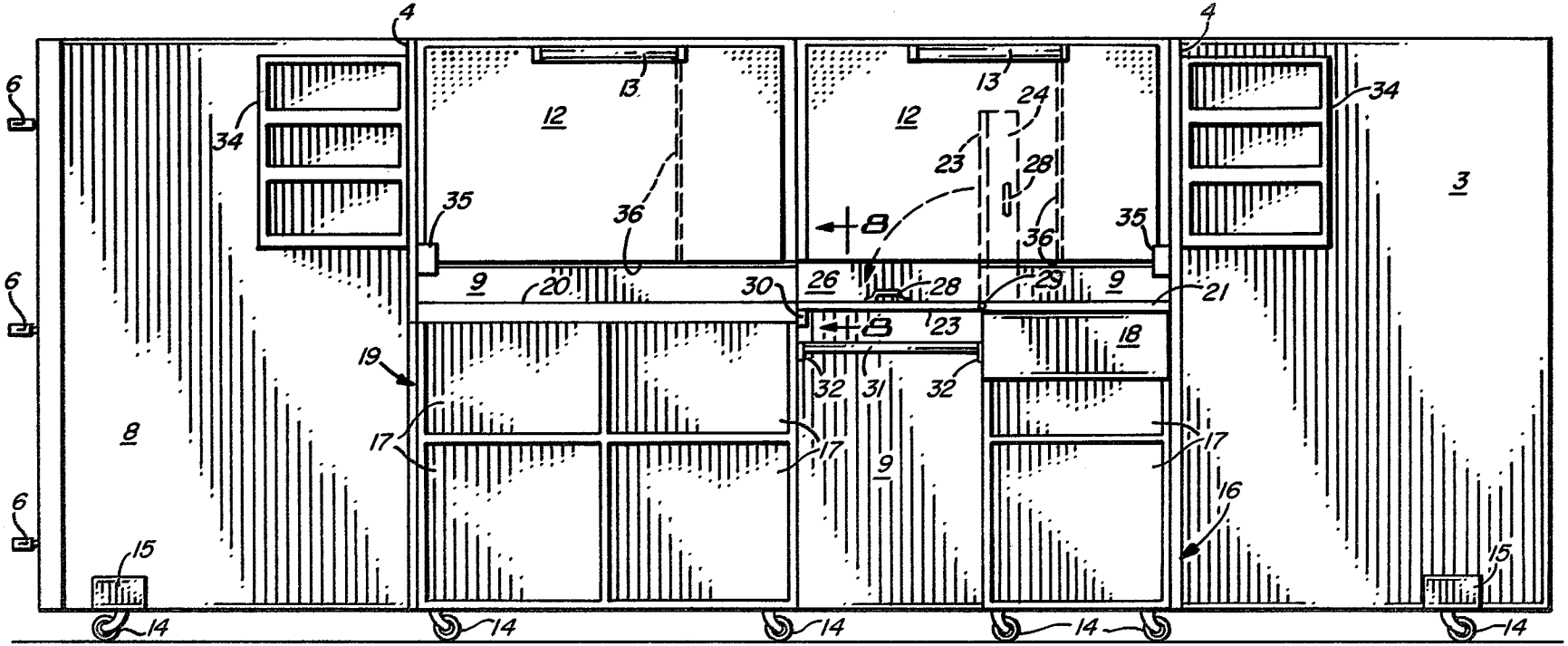
FIG. 4 is a front elevation of the portable workshop, with the panels deployed in a fully open, linear and functional configuration.
Figure 7:
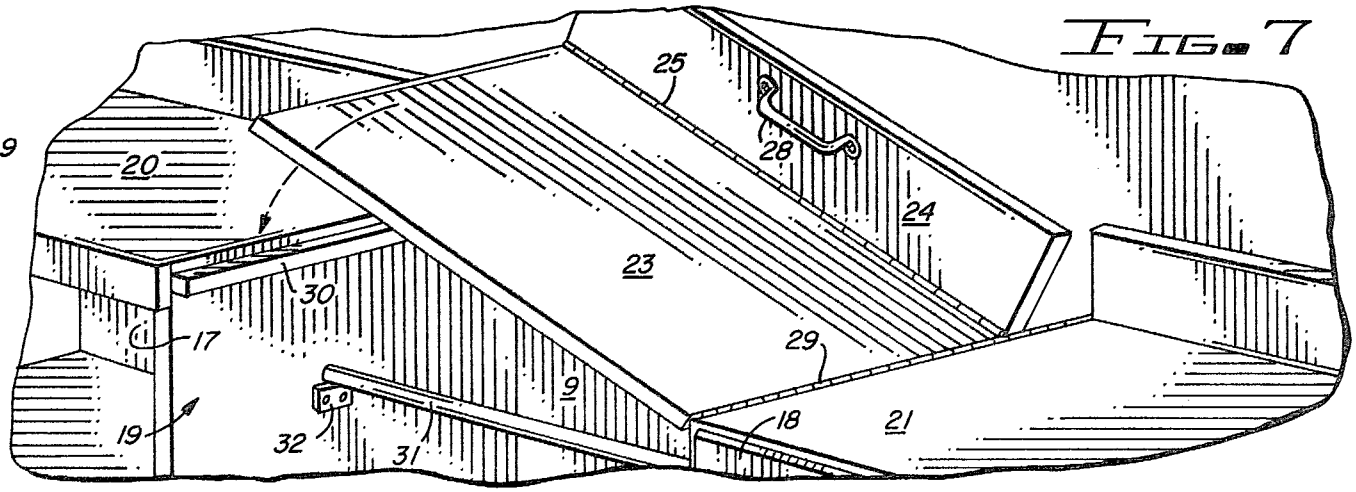
FIG. 7 is a perspective view, partially in section, of a preferred folding counter for extending the horizontal working area in the portable workshop.
Figure 8:
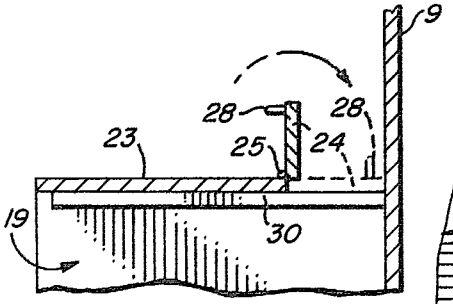
FIG. 8 is a sectional view, taken along lines 8—8 in FIG. 4, more particularly illustrating the folding counter design.

Referring now to FIGS. 2, 3, 4 and 7 of the drawings, in yet another most preferred embodiment of the invention, a hinged counter 23 is provided in the portable workshop 1 to make available a horizontal work space or area between the double cabinet top 20 of double cabinet 19 and the single cabinet top 21, of single cabinet 16. The counter 23 is attached to the single cabinet 16 by means of a counter hinge 29, and counter 23 can be deployed on counter hinge 29 from a non-functional position rearwardly toward single cabinet top 21, to a substantial alignment with double cabinet top 20 and single cabinet top 21. When so disposed in functional position, the counter 23 rests on the counter support 30, attached to double cabinet 19, as illustrated in FIGS. 4 and 7. In order to facilitate a full range of motion from a functional position in alignment with the double cabinet top 20 and the single cabinet top 21 as illustrated in FIG. 4, the counter 23 includes a counter segment 24, which is attached to the counter 23 by means of a counter segment hinge 25. A handle 28 is attached to the counter segment 24 to provide a means for manipulating the counter segment 24 on the counter segment hinge 25, to permit counter 23 to clear the pegboard 12 located above single cabinet 16, as the counter 23 moves in an arc past the pegboard 12, and past any tool or tools which may be suspended on the pegboard 12 in the arc. In another most preferred embodiment of the invention a cabinet spacer 31 is removably provided in spacer brackets 32, located on single cabinet 16 and double cabinet 19, respectively. The cabinet spacer 31 serves to maintain the proper distance between single cabinet 16 and double cabinet 19 when the portable workshop 1 is in deployed and functional configuration, as illustrated in FIG. 4, in order that counter 23 might be hingedly folded to bridge the distance between double cabinet top 20 and single cabinet top 21.

Referring again to FIG. 4 of the drawing, when the portable workshop 1 is in fully deployed and functional configuration, easy access is provided to the cabinet compartments 17 in single cabinet 16 and double cabinet 19, to the drawer 18 in single cabinet 17, and to the shelves 34 and the pegboards 12, for efficient use of the portable workshop 1.

In yet another preferred embodiment, electrical boxes 35 are provided above the double cabinet top 20 and single cabinet top 21, respectively, and mounted on each panel facing 4, in order to conveniently make use of power tools. Wiring 36, illustrated in phantom, connects the electrical boxes 35 with a central plug 22, illustrated in FIG. 1, which can be plugged into an extension cord or other conduit to supply electricity to the portable workshop 1.

Figure 5:
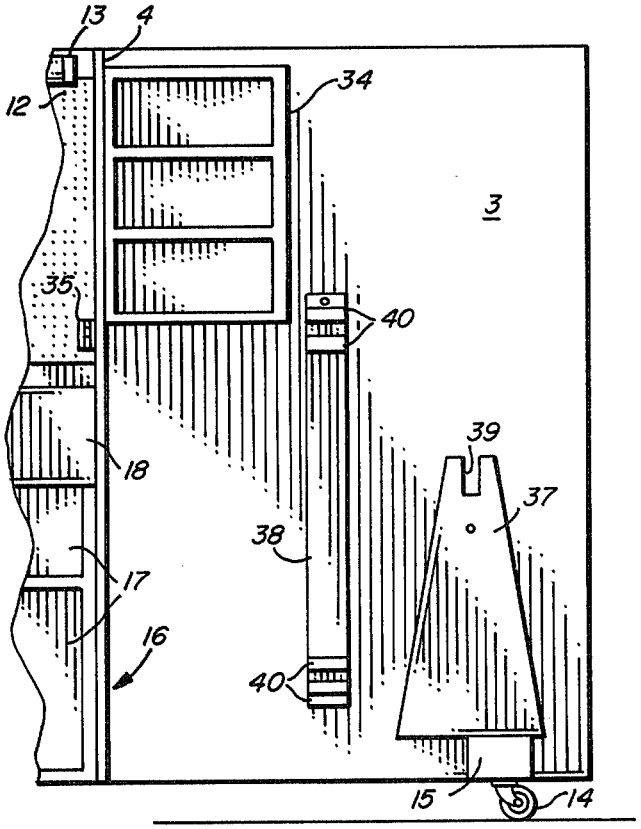
FIG. 5 is a front elevation, partially in section, of the door panel of the portable workshop.
Figure 6:
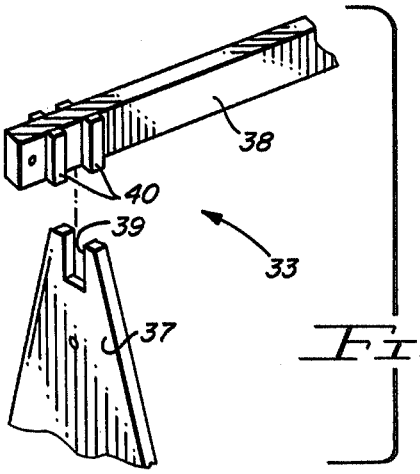
FIG. 6 is a perspective view, partially in section, of a preferred work support leg and brace design for a work support member.

Referring now to FIGS. 5 and 6 of the drawing, in a still further preferred embodiment of the invention the work support legs 37 and work support brace 38 of an auxiliary work support 33 are mounted on door panel 3, and work support 33 can be assembled from work support legs 37 and the cooperating work support brace 38, as illustrated in FIG. 6, to provide an additional working surface for use in connection with the portable workshop 1. As further illustrated in FIG. 6 the work support brace 38 is provided with brace ribs 40, which are spaced to register with a cooperating leg slot 39, provided in work support legs 37, to shape and support each end of the work support 33.

Referring again to the drawings, it will be appreciated by those skilled in the art that the portable workshop 1 can be shaped from multiple panels to provide a geometric enclosure of desired character. However, in a most preferred embodiment, four such panels are used, and the door panel 3, with the cooperating panel facing 4, the closure panel 8, also with the adjacent panel facing 4, and each of the rear panels 9 are about 4 feet by 8 feet in size respectively, to define an enclosure 2 which occupies a space of about 16 square feet when in folded configuration. Furthermore, various desired sizes, configurations and locations of shelves 34 and pegboards 12 can be provided inside the portable workshop 1 and mounted to the door panel 3, closure panel 8 and the rear panels 9, respectively, according to the particular needs and desires of the user. For example, while the lights 13 are illustrated as florescent lighting in the drawings, it will be appreciated that incandescent lights or other lighting known to those skilled in the art, can also be used as desired. Furthermore, the location, number and size of the single cabinet 16 and double cabinet 19 can also be varied to suit the particular needs of the user. However, in a most preferred embodiment of the invention it has been found that the specific spatial orientation of the utility means, such as the single cabinet 16 and double cabinet 19 on the rear panels 9, respectively, illustrated in the drawings is particularly advantageous when used in cooperation with the folding counter 23, to provide maximum horizontal work space and still facilitate the folding function of the portable workshop 1. Other utility means and modifications, which include a second work support 33 attached to the inside surface of the closure panel 8, and a vise secured to the double cabinet top 20 or single cabinet top 21, as well as storage jars or receptacles carried by the shelves 34, can be provided, in non-exclusive particular, according to the knowledge of those skilled in the art.

As heretofore described, the portable workshop of this invention can be used both outside and inside the home, and is particularly well adapted for garage and carport use in homes which are either sparsely provided with, or are not equipped with a workshop, work bench or storage facilities such as cabinets, shelves and pegboards, to accommodate tools, supplies and equipment. The portable workshop can be completely deployed in linear configuration, as illustrated in FIG. 4 of the drawings, or it can be partially opened, as illustrated in FIGS. 2 and 3 to provide shelter from wind in cold weather when the workshop is used outside.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A portable workshop comprising:

(a) a pair of rear panels having substantially parallel edges in adjacent relationship, a first panel facing member rigidly attached to one of said rear panels and a second panel facing member rigidly attached to the other of said rear panels, a door panel positioned adjacent said first panel facing member and a closure panel positioned adjacent said second panel facing member;

(b) rear panel hinges joining said parallel edges of said rear panels, and first panel hinges attached to vertical edges of said door panel and said first panel facing member and second panel hinges attached to vertical edges of said closure panel and said second panel facing member, respectively, whereby said rear panels are hingedly joined to each other along adjacent vertical edges and are fixedly joined to said panel facing members at the opposite vertical edges, respectively, and said door-panel is hingedly joined to said first panel member, and said closure panel is hingedly joined to said second panel facing member;

(c) a first cabinet attached to a first one of said rear panels and having a first generally horizontally-disposed cabinet top for use as a work space and first compartments for storing tools and supplies;

(d) a second cabinet attached to a second one of said rear panels in spaced relationship to said first cabinet and having a second generally horizontally-disposed cabinet top in substantial alignment with said first cabinet top for use as a work space and second compartment for storing tools and supplies;

(e) a pair of pegboards mounted on said rear panels above said first cabinet and said second cabinet, respectively;

(f) counter means hingedly attached to said first cabinet and foldable on said first cabinet top to bridge the space between said first cabinet top and said second cabinet top and counter segment means hingedly carried by said counter means along one edge of said counter means adjacent said one of said rear panels and foldable on said counter means to facilitate folding of said counter means past said pegboard from said first cabinet top to said second cabinet top; and (g) cabinet spacer means having one end pivotally attached to said first cabinet and pivotally disposed to extend between said first cabinet and said second cabinet, whereby said first cabinet is properly spaced from said second cabinet when said portable workshop is in the open configuration.

2. The portable workshop of claim 1 further comprising at least one work support characterized by a brace provided with brace ribs in spaced relationship at each end of said brace, and a pair of work support legs having a slot at the top thereof, respectively, said legs fitted to said brace in spaced relationship with said slot engaging said brace ribs, respectively, when said work support is in functional configuration, and said brace and said legs removably attached to said door panel when in stored configuration.

3. The portable workshop of claim 2 wherein said at least one work support is a first work support secured to said door panel and a second work support secured to said closure panel.

4. The portable workshop of claim 1 further comprising wiring, at least one electrical outlet box and at least one light means in cooperation with said wiring, said wiring, said outlet box and said light means carried by said panel members.

* * * * *